US008171755B2

(12) United States Patent
Jahn et al.

(10) Patent No.: US 8,171,755 B2
(45) Date of Patent: May 8, 2012

(54) KNIT GOODS WITH MOISTURE SENSOR

(75) Inventors: Michael Jahn, Missen Wilhaus (DE); Wolfgang Von Riedheim, Immenstadt (DE); Claudia-Susanne Franke, Blaichach (DE); Mike Oertel, Elterlein (DE); Klaus Meier, Geislingen (DE)

(73) Assignee: Kunert Fashion GmbH & Co, KG, Immensteadt (DE)

( * ) Notice: Subject to any disclaimer, the term of this patent is extended or adjusted under 35 U.S.C. 154(b) by 0 days.

(21) Appl. No.: 12/944,362

(22) Filed: Nov. 11, 2010

(65) Prior Publication Data

US 2011/0132040 A1 Jun. 9, 2011

(30) Foreign Application Priority Data

Nov. 12, 2009 (DE) ..... 10 2009 052 929

(51) Int. Cl.
*A41B 9/00* (2006.01)
*D04B 1/14* (2006.01)

(52) U.S. Cl. ..... 66/177; 66/170

(58) Field of Classification Search ..... 66/169 R, 66/170, 171, 191, 192, 193, 202
See application file for complete search history.

(56) References Cited

U.S. PATENT DOCUMENTS

| | | | | |
|---|---|---|---|---|
| 4,668,545 | A * | 5/1987 | Lowe | 428/35.1 |
| 4,753,088 | A * | 6/1988 | Harrison et al. | 66/202 |
| 4,874,659 | A * | 10/1989 | Ando et al. | 428/221 |
| 5,103,504 | A * | 4/1992 | Dordevic | 2/243.1 |
| 5,416,961 | A * | 5/1995 | Vinay | 28/165 |
| 5,991,922 | A * | 11/1999 | Banks | 2/69 |
| 6,047,203 | A * | 4/2000 | Sackner et al. | 600/388 |
| 6,145,551 | A * | 11/2000 | Jayaraman et al. | 139/387 R |
| 6,210,771 | B1 * | 4/2001 | Post et al. | 428/100 |
| 6,315,009 | B1 * | 11/2001 | Jayaraman et al. | 139/387 R |
| 6,341,504 | B1 * | 1/2002 | Istook | 66/172 E |
| 6,381,482 | B1 * | 4/2002 | Jayaraman et al. | 600/388 |
| 6,413,225 | B1 * | 7/2002 | Sackner et al. | 600/529 |
| 6,414,286 | B2 * | 7/2002 | Rock et al. | 219/545 |
| 6,474,367 | B1 * | 11/2002 | Jayaraman et al. | 139/383 R |
| 6,551,252 | B2 * | 4/2003 | Sackner et al. | 600/536 |
| 6,603,403 | B2 | 8/2003 | Jeutter et al. | |
| 6,687,523 | B1 * | 2/2004 | Jayaramen et al. | 600/388 |
| 6,854,296 | B1 * | 2/2005 | Miller, III | 66/190 |
| 6,941,775 | B2 * | 9/2005 | Sharma | 66/202 |
| 6,970,731 | B1 * | 11/2005 | Jayaraman et al. | 600/388 |
| 2007/0130676 | A1 | 6/2007 | von Blucher | |

FOREIGN PATENT DOCUMENTS

| | | |
|---|---|---|
| DE | 102006004946 | 6/2007 |
| DE | 60122828 | 1/2008 |
| WO | 2004100784 A2 | 11/2004 |
| WO | 2007050650 | 5/2007 |

* cited by examiner

*Primary Examiner* — Danny Worrell
(74) *Attorney, Agent, or Firm* — Fitch, Even, Tabin & Flannery

(57) ABSTRACT

A knit fabric comprising a knit base containing at least one thread of a material, said thread changing its electrical resistance under the influence of moisture, is provided with an incorporated moisture sensor that comprises at least two spaced apart electrically conductive electrodes. Rows or columns of stitches of the knit base are located between the electrodes. Each of the electrodes contains at least one electrically conductive thread that is knit together with the knit base and that is in electrical connection with electrical connecting means (16) that are accessible from the outside.

16 Claims, 2 Drawing Sheets

KNIT GOODS WITH MOISTURE SENSOR

CROSS-REFERENCE TO RELATED APPLICATION

The present application claims the priority of German Patent Application No. 10 2009 052 929.2-26, filed Nov. 12, 2009, the subject matter of which, in its entirety, is incorporated herein by reference.

BACKGROUND OF THE INVENTION

The invention relates to a knit product comprising a knit base in which a base thread is incorporated and that, in a manner known per se, may comprise any pattern and/or design that is appropriate for the intended purpose of use.

In nursing facilities, in particular in elder care, it is frequently a problem for bed-ridden patients that care providers will only find out after many hours that a patient has wet his or her bed. Inasmuch as this also frequently occurs while sleeping, even those who are afflicted notice this only after several hours. As a result, such patients will rest for hours in a moist or even wet bed. This considerably intensifies the discomfort of developing bed sores. Apart from the added problems experienced by the patient as a result of this, additional efforts required on behalf of these patients result in high costs in healthcare.

If it were possible to promptly report wetting to care providers, patients could be cared for immediately. A patient would no longer lie for hours in a moist or wet bed and would thus not develop bed-sores as quickly.

Basically, in cases of strong perspiration, similar problems may occur in garments such as for example, in knit sweaters and the like, or in knit underwear. Also in these instances, considering certain illness conditions, there may be a need to report perspiration break-outs or the like directly to a station so that appropriate measures may be taken. Likewise, similar problems occur with infants whose cribs are provided with mattress liners or coverlets that are occasionally wet through.

There are textile moisture sensing arrangements that consist of woven material into which electrically conductive and electrically poorly conductive threads are woven in such a manner that electrically poorly conductive threads are located between electrically conductive threads. Inasmuch as the electrical resistance changes when the action of moisture changes, a monitoring of the electrical conductivity in the knit fabric between the electrically conductive threads allows the detection of moisture occurring in the fabric.

A woven material comprises crossing weft and warp thread systems whose threads are not only firmly locked with other on their binding points but are also readily accessible from the side of the fabric selvedge in order to be able to attach electrical lines. However, there are applications, in particular in the case of undergarments in which woven fabrics are not practical or disadvantageous compared with knit fabrics. Considering knit fabrics, i.e., a non-woven, the stitches formed by the respective thread are hinged to each other on their stitch loops and are thus changeable in view of their size as well as relative to each other when stressed. Consequently, any findings and experiences gained with woven goods can not be simply applied to knit goods.

It is the object of the invention to solve the aforementioned problems in the case of knit fabrics and, in particular also in the case of garments and the like that contain a knit item or are produced in full or in part of such a knit item.

SUMMARY OF THE INVENTION

The above object generally is achieved according to the present invention by the knit item in accordance with the invention wherein the knit item is processed, as already mentioned, with any knit base that comprises at least one thread of a material that changes its electrical resistance under the influence of moisture. The knit item is provided with a moisture sensor that comprises at least two spaced apart, electrically conductive electrodes between which are arranged rows or columns of stitches of the knit base, each of said electrodes containing at least one electrically conductive thread that is knit together with the knit base and is in electrical contact with electrical connecting means that are accessible from the outside.

An electrode may comprise at least one part extending in the direction of the column of stitches and/or in the direction of the row of stitches of the knit base, whereby at least one electrically conductive thread is knitted in stitches into said part. In a preferred embodiment, the arrangement may be such that at least two electrodes extend in a comb-like manner, said electrodes having a first part extending in stitch column direction and second parts extending therefrom in stitch row direction, in which case the second parts of the two electrodes are arranged so as to mesh with each other.

The part of an electrode that extends in stitch column direction may at least in parts be formed by stitches, in which stitches an electrically conductive thread is incorporated by knitting and which are connected with each other. The stitches of the one or more stitch columns that make up this electrode part—which may also be a whole electrode—are the electrically conductive threads that are mechanically anchored together due to the stitch structure of the knit fabric and are also held in fixed mutual electrical contact with each other, so that a continuous electrical contact path is achieved. In doing so, respectively, individual thread pieces of an electrically conductive thread may be knit into the stitches of at least one stitch column of the electrode part extending in stitch column direction, whereby the thread pieces of adjacent stitches in the stitch assembly are in the mentioned electrical contact with each other.

The electrically conductive thread may be plated—at least in the region of the respective electrode—to a base thread of the knit base. As a rule, this has the result that, at least in the region of the electrode parts extending in stitch column direction, cut off ends of the electrically conductive thread occur. Such thread ends may be avoided if the electrodes are at least partially knitted using intarsia technique, i.e., contain stitches into which the electrically conductive thread has been knitted and which are combined with the knit base by intarsia technique. In conjunction with this, intarsia technique is understood to mean a knitting technique that has been known per se. Examples of such intarsia techniques are found, for example, in "Strickerei-Lehrgang Dubied" [Dubied knitting course], Eduard Dubied & Cie. S. A., Neuchatel, Switzerland, 1967.

Basically, it needs to be noted that the electrodes containing the electrically conductive thread may be knitted in any, respectively practical, pattern, i.e., stitch distribution and stitch design. In doing so, electrically conductive threads may also be positioned floating over one or more stitches in stitch column direction or in stitch row direction.

A particularly advantageous application of the new knit fabric is that it is part of a garment in which the action of moisture is to be monitored. This garment may be a pair of pants in which the knit fabric with the incorporated moisture sensor is provided in the crotch region. In the crotch region, the knit fabric with the incorporated moisture sensor may be covered, at least on one side, by a moisture-permeable textile material consisting of cotton fibers, for example.

The electrical connecting means for the electrodes of the moisture sensor of the new knitted goods may be appropriately adapted to the respective application. The connecting means may comprise clamps, connector elements and the like that enable the connection of electrical lines. These also include direct signal transmitters in the form of small emitters, Bluetooth devices and the like, these being potentially directly fastened to the garment and emitting wireless signals that can be received by an appropriate receiver. Considering the mentioned pants that may also be referred to as incontinence pants, the electrical connecting means are electrical lines that are suitably electrically connected with the electrically conductive threads of the electrodes. Advantageously, each of the electrical lines comprises an electrically conductive yarn around which an electrically insulating yarn is knit. Inasmuch as, usually, the electrical connection between the moisture sensor of the pants and the monitor unit requires two electrical leads, the arrangement may advantageously be such that at least two lines, respectively, consisting of an electrically conductive yarn and its knit sheath of electrically insulating yarn forming a bendable multi-lead textile cable, are enclosed together in a protective knit sheath. Thus, a two-lead or multi-lead textile "conducting wire" is obtained, this wire being used to create the electrical connection. The advantage of this textile conducting wire compared with otherwise known cords or lines is its textile behavior. Inasmuch as it consists of textile threads, the conducting wire is extremely flexible and also elastic. It possesses extremely small bending radii and, at worst, is perceived as if it were a string.

The electrically conductive yarn or the textile conducting wire or conducting cable can be connected with the electrodes in various ways. It is only necessary that perfect electrical contact closing be ensured. In doing so, the electrically conductive yarn of the electrical line may be knotted to the electrically conductive thread of the respective electrode. The ends of the conducting wire containing the electrically conductive yarn may also be connected with the electrically conductive yarn ends of the electrodes, for example, with the use of a hook-and-loop fastener, or the conducting yarn may be firmly sewn to the electrodes—just to mention a few particularly practical embodiments.

The configuration of the electrodes of the moisture sensor must be selected so as to be adapted to the expected moisture action in the respective application. Inasmuch as the electrodes are formed by electrically conductive threads that are knitted in stitches, any pattern appropriate for the given purpose of use may be selected for the knit fabrics, said pattern ensuring the optimal localization and distribution of the electrically conductive threads in the region that is to be monitored. Apart from being the already mentioned comb-like meshing electrodes, the electrodes may also have small branches that extend over several rows and columns of stitches. Also, it is not absolutely necessary that the electrodes' electrical conducting paths formed by electrically conductive threads in the knit fabric extend exactly in stitch column direction or in stitch row direction. By appropriate patterning, it is also possible to inexpensively produce conducting paths extending diagonally with respect to the stitch columns and stitch rows or conducting paths that are circular or wave-shaped.

The drawings show exemplary embodiments of the subject matter of the invention.

DETAILED DESCRIPTION OF THE INVENTION

Figure 1:
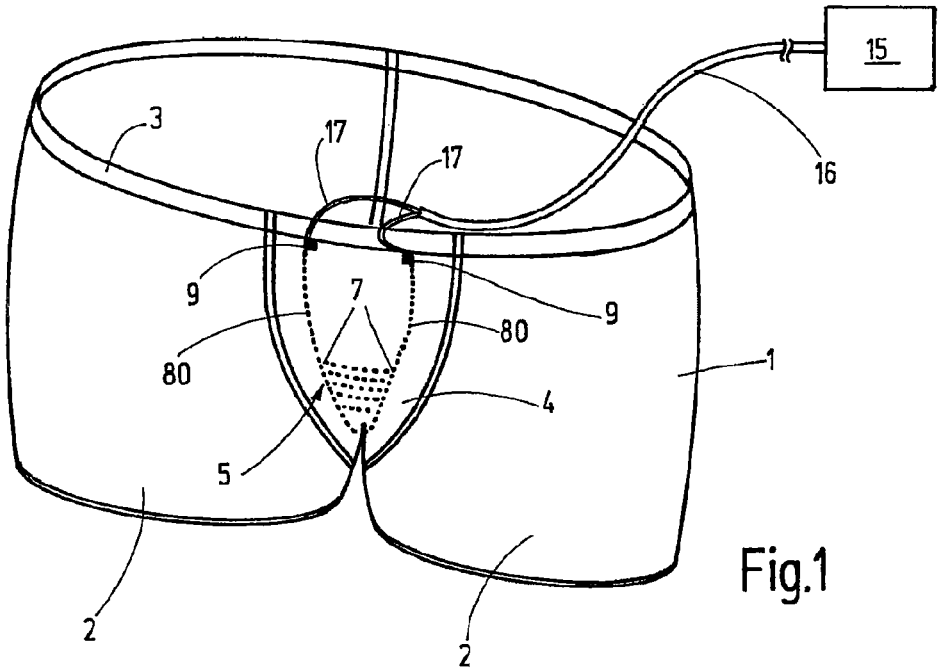
FIG. 1 is a perspective schematic representation of pants, in which a crotch piece of a knit fabric in accordance with the invention has been inserted.

The pants 1 shown in FIG. 1 are made with an incorporated moisture sensor, these representing so-called incontinence pants. These incontinence pants consist of a function-specific textile material, preferably a non-woven, and consist of two leg parts 2 and a waist-band 3. A crotch piece 4 is interposed in the crotch region located between the two leg parts 2, said crotch piece consisting of the knit fabric shown in FIGS. 5, 6, with a moisture sensor 5 incorporated in said knit fabric. The knit crotch piece 4 is sewn into the pants 1 or attached to the seam of the pants in an other manner that is appropriate for this purpose.

Figure 5:
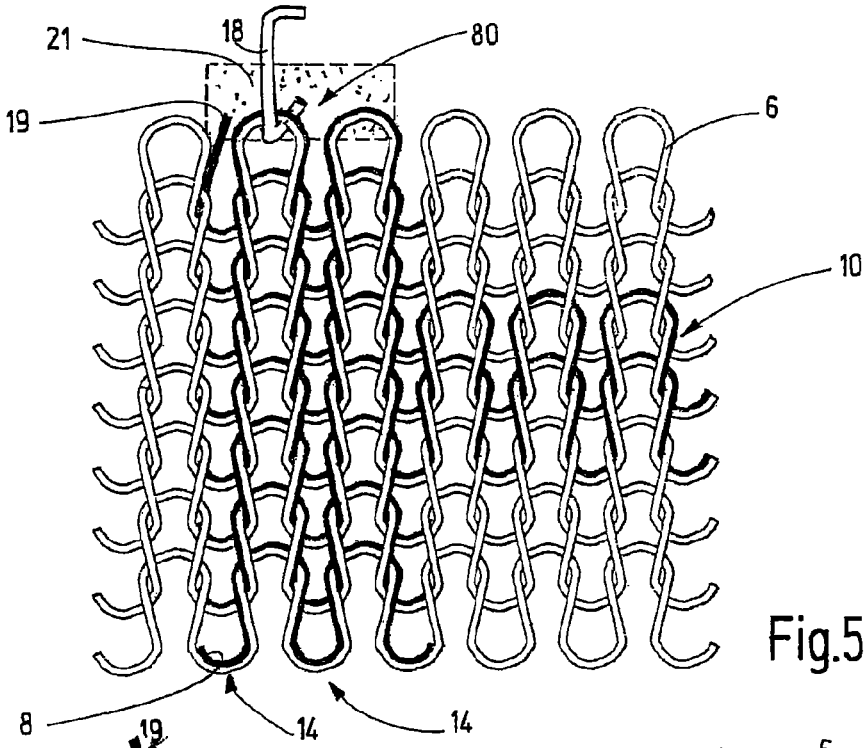
FIG. 5 is a detail of the stitch pattern appearance of the crotch in accordance with FIG. 2 or 3 in the region of an electrode, showing an electrically conductive thread applied by plating.
Figure 6:
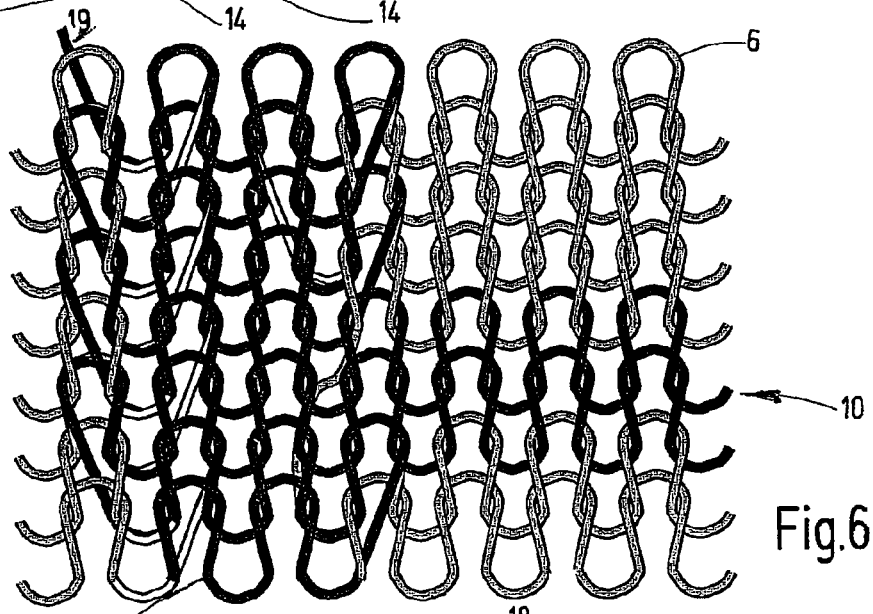
FIG. 6 is a detail of the stitch pattern appearance in accordance with FIG. 6, showing an electrically conductive thread knitted in by intarsia technique.

The crotch piece 4 comprises a knit base, for example consisting of a base thread 6 knit together by right-to-left binding as is shown by the details depicted in FIGS. 5, 6. The base thread 6 consist of a fiber material that changes its electrical resistance under the influence of moisture. Such a fiber material consists of cotton, for example. The electrical conductivity of the fibers is greatly defined by their moisture content, whereby the electrical resistance decreases as the moisture increases. Fiber materials displaying similar characteristics are, among others, viscose, acetate, hemp fibers (linen), but also synthetic fiber materials.

Figure 2:
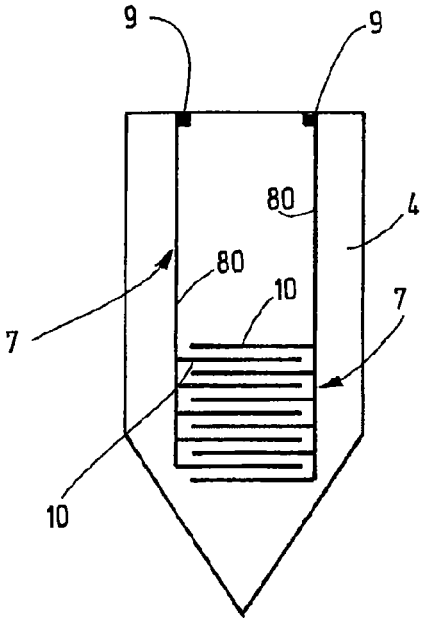
FIGS. 2 and 3 are a plan view and a schematic representation, respectively, of two different embodiments of the crotch of the pants in accordance with FIG. 1.
Figure 3:
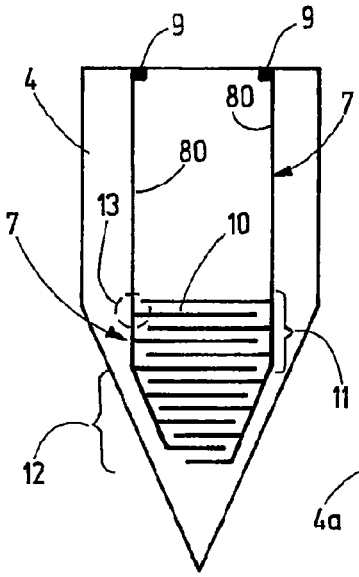

Two spaced apart electrodes 7 are knitted into the knit base knitted from the base thread 6, whereby the basic pattern design of two embodiments is obvious from FIGS. 2 and 3. Each of the electrodes 7 contains an electrically conductive thread 8 that is shown dark in FIGS. 5, 6. Various embodiments of electrically conductive textile threads are commercially available. As a rule, they are made in the form of yarns that include copper and silver monofilaments having a small diameter (for example, 10 to 30 μm and less) and textile threads that are optionally twisted with each other. For example, such electrically conductive yarns have been described in EP 0 816 543 B1 and WO 093/24689. Rows of stitches and/or columns of stitches of the knit base are located between the two electrodes 7, so that any moisture of the pants 1 in the region of the crotch piece 4 can be detected with the aid of the electrodes 7. This is accomplished in that the electrical resistance between the two electrodes 7 is measured. Because, as has been mentioned, the electrical conductivity of the fiber material in the parts located between the electrodes 7 increases—said parts consisting of the base thread 6 of the knit base—the electrical resistance measured between the electrodes 7 decreases accordingly as the moisture increases.

Each of the electrically conductive threads of the electrodes 7 is electrically connected with electrical connecting means that are accessible from the outside, said connecting means—in turn—forming a connection with a monitoring and/or signal station. If the measured electrical resistance between the electrodes 7 falls below a threshold value, a signal may be directly sent, for example, to the nurses' station of the care facility.

Figure 7:
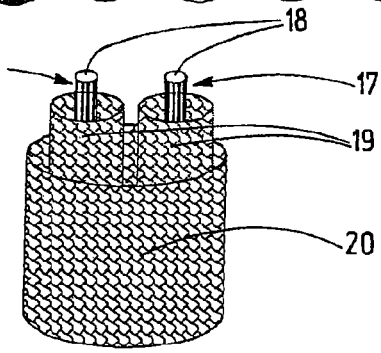
FIG. 7 is a schematic perspective sectional view of the electrical connecting line of the moisture sensor of the pants in accordance with FIG. 1.

Various techniques may be used for knitting the electrodes into the knit base of the base thread 6, two of said techniques being shown by FIGS. 6, 7.

As is obvious from the schematic representation of the electrically conductive conductor paths of the electrodes 7 of the moisture sensor 5 in FIGS. 2 and 3, each electrode 7 has an elongated first part 80 that extends in stitch column direction of the knit base and leads to the connecting points 9 on the waist-band of the pants 3. In the present case, several second electrode parts 10 extend at a right angle from this first electrode part 80, said second electrode parts 10 extending in the direction of the stitch rows, as is obvious from FIGS. 5, 6. The second electrode parts 10 of the two electrodes 7 mesh in a comb-like manner. The appearance of the pattern of the electrodes 7 in the crotch piece 4 may be designed, for example, as in FIG. 2, whereby the second electrode parts 10 of each electrode 7 have the same length. In a modified embodiment in accordance with FIG. 3, the arrangement is such that the second electrode parts 10 have the same length only in an upper crotch region 11 containing the moisture sensor 5 and are increasingly shorter in an adjoining lower crotch region 12 in order to thus achieve an adaptation to the downward tapering shape of the crotch piece 4. Of course, other pattern options are conceivable.

Each of FIGS. 5 and 6 shows a detail of an electrode 7, for example in region 13 of FIG. 3, where a second electrode part 10 extends from a first electrode part 8. The figures show the knitting technique used for the construction of the electrodes 7.

In the embodiment in accordance with FIG. 5, the electrically conductive thread 8 is plated to the base thread 6. The first electrode part 80 extending in stitch column direction is composed of separate pieces of the electrically conductive thread 8, said pieces being knitted into the stitches of two adjacent stitch columns 14. The length of these thread pieces is such that the thread pieces in the regions of the electrode 7, said regions only comprising the first electrode part 8, essentially extend across two adjacent stitches of each row of stitches; whereas, in the region of the second, laterally extending electrode parts 10, the thread pieces extend, for example, in two adjacent rows of stitches, across a length of the number of stitches corresponding to the respective second electrode part 10.

The thread pieces of the electrically conductive thread 8 located in the stitches of the stitch columns 14 are held in the knit base by the stitch assembly in electrical contact with each other, so that a continuous electrical conductor path is achieved along the length of the stitch columns 14 up to the connecting point 9 of FIG. 2. At each stitch, the electrical contact occurs in stitch column direction across the crossing points in the stitches.

As a rule, due to the small diameter of the electrically conductive copper or silver filaments, the thread ends of the cut off thread pieces of the electrically conductive thread 8 are not troublesome. However, if it is important that rubbing spots formed by these thread ends be avoided and that a smooth surface of the knit fabric be achieved, the patterns of the electrodes 7 may also be incorporated by using an intarsia knitting technique as illustrated by FIG. 6:

The electrode 7, with its first electrode part 80 extending in stitch column direction and its second electrode parts 10 extending in stitch row direction, is knit in a pattern using only one single electrically conductive thread 8. On the selvedge stitches of the pattern, the electrically conductive thread 8 is looped together with the adjacent stitches of the knit base formed by the base thread 6 as is characteristic of the known intarsia technique.

Referring to the shown embodiment, an electrical line 16 containing two leads 17 that are conductively connected with the connecting points 9 by means of the electrically conductive threads 8 of the electrodes 7 is disposed to provide the electrical connection between the electrodes 7 of the moisture sensor 5 and a monitor unit 15 comprising an electrical resistance measuring device as indicated at 15 in FIG. 1. In accordance with the invention, the electrical line 16 is configured as a special textile line. It consists of a core of an electrically conductive yarn 18 (FIG. 7), the latter forming the two leads 17 and being sheathed by a knit fabric of electrically insulating yarn 19 in order to prevent short-circuiting. The to leads 17 that are insulated from each other in this manner are contained—together with their insulation—in another knit sheath 20. Compared with otherwise known cords or lines, the thusly created two-lead or also multi-lead textile line is characterized by the advantage of distinct textile behavior. Inasmuch as said line consists of textile threads it is extremely flexible and also elastic. It possesses very small bending radii.

As has already been mentioned, the leads 17 may be connected in many ways with the electrodes 7 on the connecting points 9. For example, the electrically conductive yarn of the leads 18 of the line 16 can be knotted together with one end 19 (FIGS. 5, 6) of the conductive thread 8 of the respective electrode 7. The end 19 of the conductive thread 8 may also be connected with the conductive yarn of the leads 18 of the line 16 by means of a hook-and-loop fastener, as is indicated at 21 in FIG. 5. Also, the conductive yarn ends of the leads 18 may simply be sewn together with the ends of the electrode parts 8, in which case the electrical contact is created at the sewing location.

The electrical line 16 described hereinabove with reference to FIG. 7 may also be directly used as a moisture sensor in that said line is knit directly into the knit base. Inasmuch as the textile insulation of the two leads 18 is water-permeable, the electrical resistance between the two leads 18 is a function of the moisture in the insulating sheaths 19, 20. If the textile line becomes wet at one point, the electrical resistance between the two leads 18 decreases accordingly. Consequently, the entire line 17 inside the knit base acts as a moisture sensor whose electrodes—depending on the way the line is knit—may extend in the direction of the stitch columns as well as in the direction of the stitch rows.

It is also conceivable to place such a sensor or also a knit fabric of the described type with incorporated moisture sensor in a bed, for example under the sheet, and to detect any moisture occurring in the bed in this manner. The advantage of this system is that the patient need no longer be connected—by way of pants or the like—to the monitor unit 15.

Exemplary Embodiment

The pants 1 shown in FIG. 1 are knitted as underpants:
Design of the pants as well as the outer layers of the crotch:
Carrier thread: EL/PA 22-22f7x1, white
Plating thread: Nm 34/1, CO combed, white
Design of the crotch piece 4:
Carrier thread: EL/PA 22-22f7x1, white 1. Plating thread: Nm 34/1, CO combed, white, forms the "base thread" 6 for the moisture sensor and is plated to the carrier thread.
2. Plating thread (electrode):

Shieldex® yarn by Zimmermann:
Wound thread of

EL 20 tex
PA 6.6 44 dtex FD-textured
44 dtex, conductive thread

Design of the electrical line 16:

Electrically conductive core thread in the form of the yarn of leads 18:

Shieldex® yarn by Zimmermann:
Wound thread of
EL 20 tex
PA 6.6 44 dtex FD-textured
44 dtex, conductive thread Thread of the sheath 20: PP78f25x6

Legend:
EL=Elastane
PA=Polyamide
CO=Cotton
PP=Polypropylene

Figure 4:
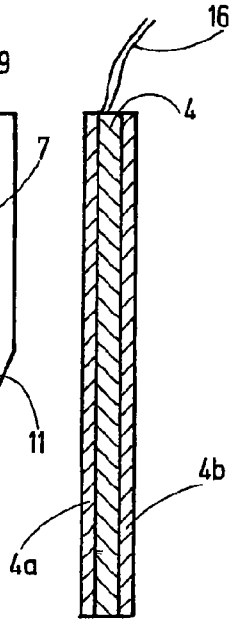
FIG. 4 is a side view and schematic representation of the crotch in accordance with FIG. 3.

With the use of the knit fabric described with reference to FIGS. 5 and 6, the crotch piece 4 may be directly inserted in the pants 1. However, in order to prevent short-circuiting due to external influences it is useful if the crotch piece 4 is made of three layers and said crotch piece is sewn in three layers into the pants 1, for example. In FIG. 1, the seams are indicated at 20. The two outer layers 4*a*, 4*b* that are knitted of cotton, for example, cover the center layer 4 comprising the sensors 7, as has been schematically illustrated in FIG. 4.

It will be appreciated that the above description of the present invention is susceptible to various modifications, changes and modifications, and the same are intended to be comprehended within the meaning and range of equivalents of the appended claims.

What is claimed is:

1. Knit fabric comprising a knit base containing at least one thread of a material, said thread changing its electrical properties under the influence of moisture, and comprising an incorporated moisture sensor that comprises at least two spaced apart electrically conductive electrodes, between which are located stitch rows or stitch columns of the knit base and which contain, respectively, at least one electrically conductive thread that is knitted together with the knit base and is in electrical connection with electrical connecting means that are accessible from the outside; and wherein at least two electrodes extend in a comb-like manner, said electrodes having a first part extending in the stitch column direction and second parts extending therefrom in the stitch row direction, with at least one electrically conductive thread being knitted into said first and second parts; and the second parts of the two electrodes are arranged so as to mesh with each other.

2. Knit fabric as in claim 1, wherein the first part of the electrode that extends in the stitch column direction is at least in parts formed by stitches, in which stitches an electrically conductive thread is incorporated by knitting and which are connected with each other.

3. Knit fabric as in claim 2, wherein individual thread pieces of an electrically conductive thread are knitted into the stitches of at least one stitch column of the electrode part extending in the stitch column direction, and the thread pieces of adjacent stitches in the stitch assembly are in electrical contact with each other.

4. Knit fabric as in claim 1, wherein the electrically conductive thread is plated—at least in the region of the respective electrode—to a base thread of the knit base.

5. Knit fabric as in claim 1, wherein the electrodes, at least partially, contain stitches into which the electrically conductive thread has been knitted and which are combined with the knit base by intarsia technique.

6. Knit fabric as in claim 1, wherein the electrically conductive thread is positioned floating over at least one stitch in the stitch column direction or in the stitch row direction.

7. Knit fabric as in claim 1, wherein said knit fabric is part of a garment.

8. Knit fabric as in claim 7, wherein the garment is a pair of pants in which the knit fabric with the incorporated moisture sensor is provided in the crotch region.

9. Knit fabric as in claim 8, wherein, in the crotch region, the knit fabric with the incorporated moisture sensor is covered, at least on one side, by a moisture-permeable textile material.

10. Knit fabric as in claim 1, wherein the electrical connecting means comprise electrical lines connected with the electrically conductive threads of the electrodes.

11. Knit fabric comprising a knit base containing at least one thread of a material, said thread changing its electrical properties under the influence of moisture, and comprising an incorporated moisture sensor that comprises at least two spaced apart electrically conductive electrodes, between which are located stitch rows or stitch columns of the knit base and which contain, respectively, at least one electrically conductive thread that is knitted together with the knit base and is in electrical connection with electrical connecting means that are accessible from the outside; and wherein the electrical connecting means comprise electrical lines connected with the electrically conductive threads of the electrodes and an electrical line contains a flexible, electrically conductive yarn around which an electrically insulating yarn is knit.

12. Knit fabric as in claim 11, wherein at least two lines, respectively, consisting of an electrically conductive yarn and its knit sheath of electrically insulating yarn forming a bendable multi-lead textile cable, are enclosed together in a protective knit sheath.

13. Knit fabric as in claim 11, wherein the electrical line is sewn to the respective electrode.

14. Knit fabric as in claim 11, wherein the electrically conductive yarn of the electrical line is knotted to the electrically conductive thread of the respective electrode.

15. Knit fabric as in claim 10, wherein the electrical line is connected with the respective electrode by means of a hook-and-loop fastener.

16. Knit fabric comprising a knit base containing at least one thread of a material, said thread changing its electrical properties under the influence of moisture, and comprising an incorporated moisture sensor that comprises at least two spaced apart electrically conductive electrodes, between which are located stitch rows or stitch columns of the knit base and which contain, respectively, at least one electrically conductive thread that is knitted together with the knit base and is in electrical connection with electrical connecting means that are accessible from the outside; and wherein the electrodes contain, as the electrically conductive thread, at least one electrically conductive textile yarn, said yarn being led as the electrical connecting means out of the knit fabric and being sheathed by a knit electrically insulating yarn in the region located outside the knit fabric.

* * * * *